US005996165A

United States Patent [19]

Stem

[11] Patent Number: 5,996,165

[45] Date of Patent: Dec. 7, 1999

[54] ABRASIVE TIPPED MULTIPURPOSE SWABS

[75] Inventor: Barbara Stem, Atlanta, Ill.

[73] Assignee: Barbara Ann Stem, Atlanta, Ill.

[21] Appl. No.: 09/031,685

[22] Filed: Feb. 27, 1998

[51] Int. Cl.[6] ..... A47L 13/04

[52] U.S. Cl. ..... 15/229.13; 15/209.1; 15/229.11; 451/524

[58] Field of Search ..... 15/208, 209.1, 15/210.1, 229.11, 229.12, 229.13; 451/523, 524, 536; 604/1

[56] References Cited

U.S. PATENT DOCUMENTS 2,006,539 7/1935 Deford ..... 15/210.1 X

FOREIGN PATENT DOCUMENTS 843657 6/1970 Canada ..... 15/209.1

847008 7/1970 Canada ..... 15/209.1

766796 1/1957 United Kingdom ..... 15/210.1

*Primary Examiner*—Mark Spisich

[57] ABSTRACT

An abrasive cleaning swab comprising a shaft having a quantity of spun material secured to the shaft by adhesive. The spun material may be either metal (eg, steel wool) or plastic and the shaft may be wood, metal or plastic. The spun material may be provided at one or both ends of the shaft.

5 Claims, 6 Drawing Sheets

ABRASIVE TIPPED MULTIPURPOSE SWABS

BACKGROUND OF INVENTION

The invention pertains to the practice of cleaning objects. The invention solves the problems of lack of abrasion and lack of durability found in prior swabs (such as cotton tipped or foam tipped).

BRIEF SUMMARY OF THE INVENTION

Abrasive tipped multipurpose swabs solve two cleaning problems, abrasion and durability, which are unsolved by prior swabs. The invention consists of a shaft of wood, metal or plastic, to the end of which is applied an adhesive, to which, in turn is applied either spun metal (such as steel wool) or spun plastic. Unlike prior swabs, the invention provides abrasion to the surface being cleaned and provides durability especially while used with liquids such as water or solvents. The object of the invention is to clean difficult to reach surfaces that are very dirty, including but not limited to, the crevices of machinery, automobile heating vents, the insides of vases and waste lines from showers and sinks. The combinations of materials can be as follows:

Wood shaft with spun metal tip.

Plastic shaft with spun metal tip.

Metal shaft with spun metal tip.

Wood shaft with spun plastic tip.

Plastic shaft with spun plastic tip.

Metal shaft with spun plastic tip.

DETAILED DESCRIPTION OF THE INVENTION

Figure 1:
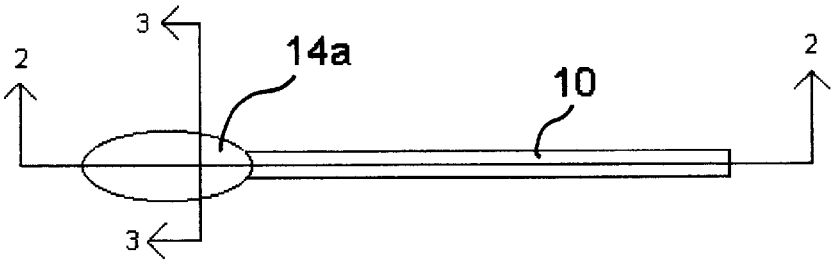
FIG. 1 Elevation view of invention with wood shaft and spun metal tip.
Figure 2:
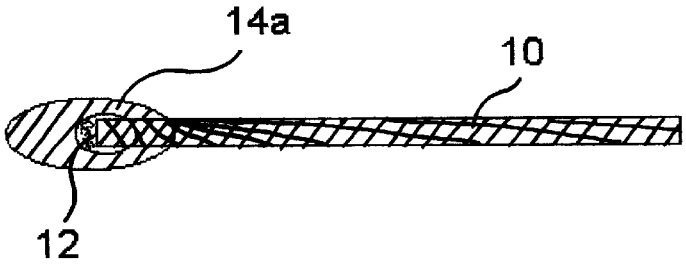
FIG. 2 Cross section view along 2—2 in FIG. 1 of invention with wood shaft and spun metal tip.
Figure 3:
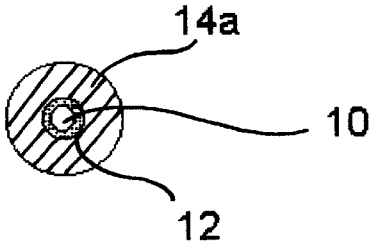
FIG. 3 End cross section view along 3—3 in FIG. 1 through tip of invention with wood shaft and spun metal tip.
Figure 4:
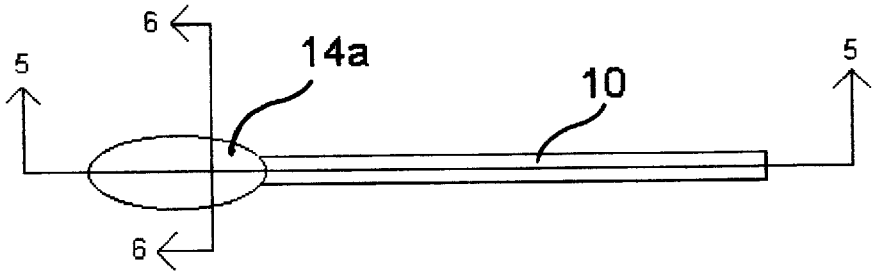
FIG. 4 Elevation view of invention with plastic shaft and spun metal tip.
Figure 5:
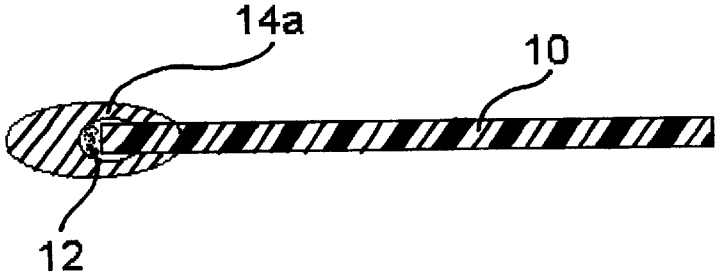
FIG. 5 Cross section view along 5—5 in FIG. 4 of invention with plastic shaft and spun metal tip.
Figure 6:
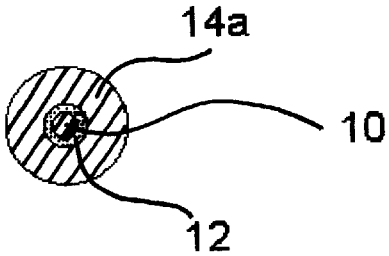
FIG. 6 End cross section view along 6—6 in FIG. 4 through tip of invention with plastic shaft and spun metal tip.
Figure 7:
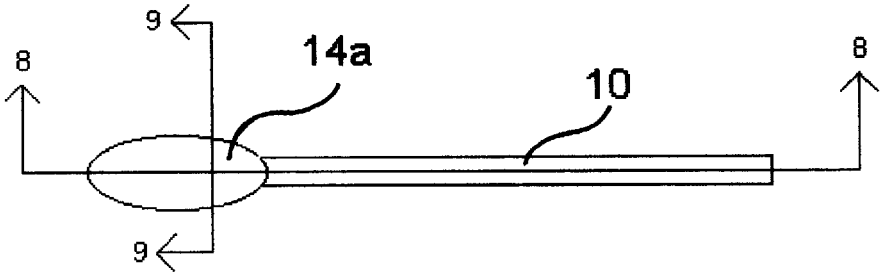
FIG. 7 Elevation view of invention with metal shaft and spun metal tip.
Figure 8:
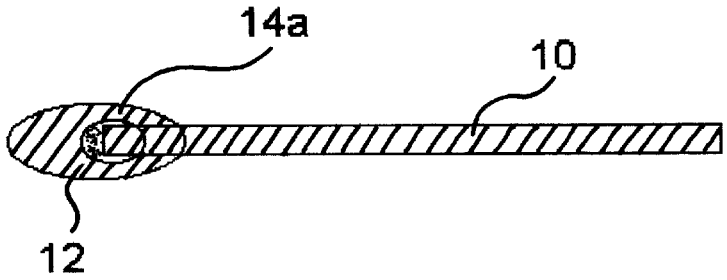
FIG. 8 Cross section view along 8—8 in FIG. 7 of invention with metal shaft and spun metal tip.
Figure 9:
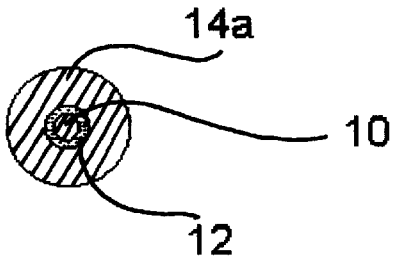
FIG. 9 End cross section view along 9—9 in FIG. 7 through tip of invention with metal shaft and spun metal tip.
Figure 10:
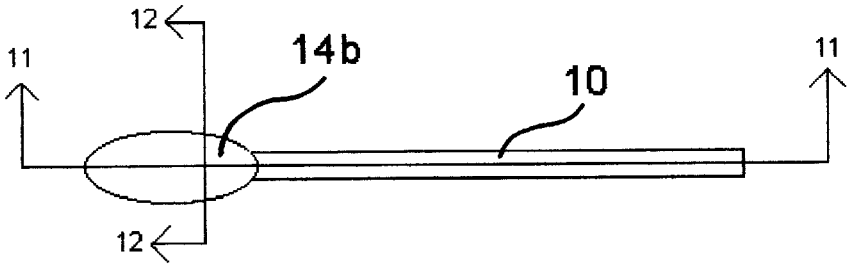
FIG. 10 Elevation view of invention with wood shaft and spun plastic tip.
Figure 11:
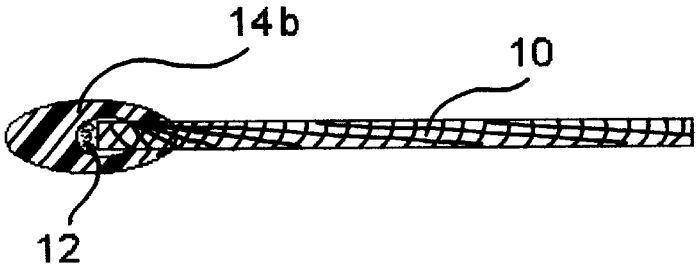
FIG. 11 Cross section view along 11—11 in FIG. 10 of invention with wood shaft and spun plastic tip.
Figure 12:
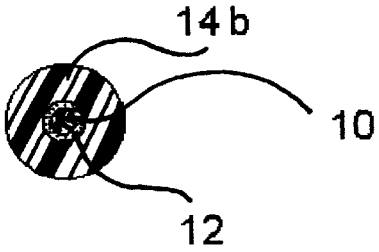
FIG. 12 End cross section view along 12—12 in FIG. 10 through tip of invention with wood shaft and spun plastic tip.
Figure 13:
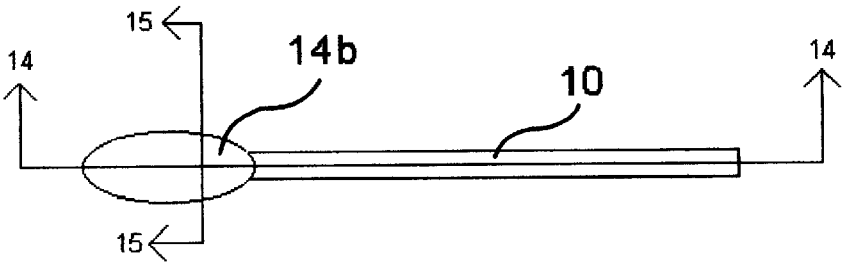
FIG. 13 Elevation view of invention with plastic shaft and spun plastic tip.
Figure 14:
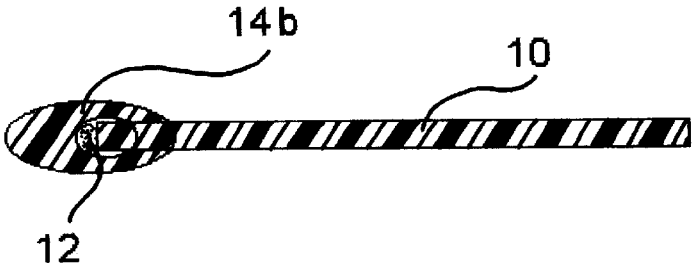
FIG. 14 Cross section view along 14—14 in FIG. 13 of invention with plastic shaft and spun plastic tip.
Figure 15:
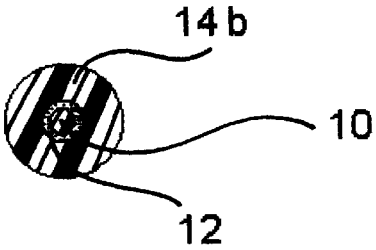
FIG. 15 End cross section view along 15—15 in FIG. 13 through tip of invention with plastic shaft and spun plastic tip.
Figure 16:
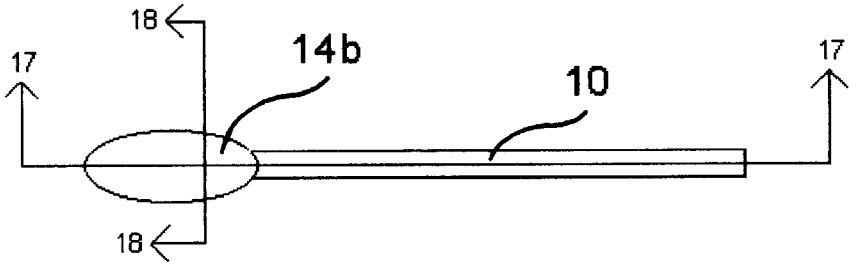
FIG. 16 Elevation view of invention with metal shaft and spun plastic tip.
Figure 17:
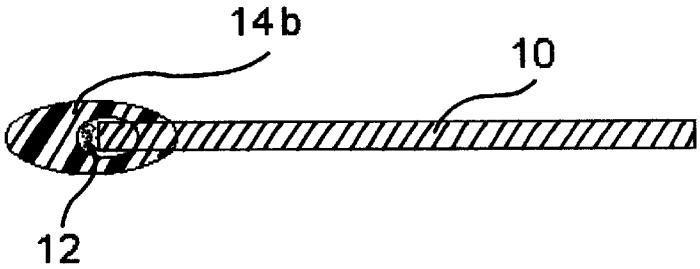
FIG. 17 Cross section view along 17—17 in FIG. 16 of invention with metal shaft and spun plastic tip.
Figure 18:
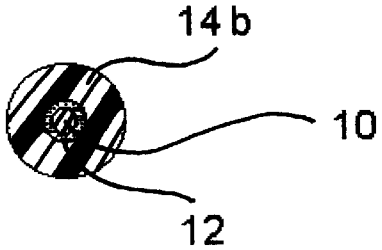
FIG. 18 End cross section view along 18—18 in FIG. 16 through tip of invention with metal shaft and spun plastic tip.

The invention consists of a shaft 10 of wood, metal or plastic, to the end of which is applied an adhesive 12, to which, in turn is applied either spun metal 14*a* (such as steel wool) or spun plastic 14*b*. The size of the shaft 10 and the amount of adhesive 12 and spun metal 14*a* or spun plastic 14*b* can vary with the use for which the swab is made. For example, a metal shaft 1/32 of an inch in diameter and 8 inches long with a tip of spun plastic ½ inch thick might be appropriate for cleaning the insides of automobile heating vents. A plastic shaft of ¼ inch diameter and 12 inches long with a spun metal tip 1 inch thick would be appropriate for cleaning the drain of a shower or sink. A wood shaft the size of an average toothpick with a head of spun plastic ¼ inch thick would be appropriate to clean the crevices of delicate porcelain figurines.

To make an abrasive tipped multipurpose swab, one selects a shaft of metal, wood or plastic in any diameter which fits inside the space to be cleaned. Then one applies adhesive to either or both ends. Then spun plastic or spun metal (such as steel wool) is wrapped around the end with adhesive.

To use the abrasive tipped multipurpose swab, one holds the shaft, places the abrasive tipped end into the orifice or crevice to be cleaned and applies pressure and torque. Examples of uses for the invention which cannot be performed with prior swabs are:

Household Cleaning

Removing

- built up grunge from waste lines from bathroom sinks and showers (prior swabs aren't abrasive enough).
- dried on food from crack between stove and countertop, from crevices between buttons and dials on kitchen equipment, from blades and walls of disposals,
- mildew and soap scum from the space between the shower door and wall or shower door and sill.
- dried on food from crevices in gasket of refrigerator door seals.
- mud from between tongue of shoe and the rest of the uppers.
- hardened build up from washing machine bleach dispenser and from space between top of washer and the lid (under the hinged side of lid).

Flood Damage Repair

Removing

- mud and silt from crevices of electrical or mechanical devises.
- mud and silt from crevices formed by carved wood on furniture or household trim or decorative items.

Automotive

Removing:

- dirt from interiors of heat and air conditioning vents
- road grime and road debris from crevices of wheels
- rust from folds of sheet metal
- corrosion from crevices on battery connections Antique Restoration Removing built up dirt on interiors of vases, lamps, porcelain, clock works, etc. In many cases the space is either inaccessible to a bottle brush and the grime is too intractable for cotton or foam tipped swabs even if a solvent or other cleanser is applied. The job calls for abrasion that is not possible with cotton or foam tipped swabs.

Food Preparation Equipment

Removing food from plungers which activate food processors.

build up from supply lines for coffee makers, ice makers.

built up grease from base of ridges on griddles.

cooked on food from spaces on grill shelves.

Equestrian

Removing built up food and saliva from spaces on bit.

mud, sawdust and horse droppings from between stirrup and stirrup pads.

Bicycling

Removing grease and grit from cog spaces on chain.

grit from inside of head tube or other metal tubing.

paint from interiors of welded on eyelets.

Hobbies

Removing scum from supply lines for aquarium equipment.

excess adhesive from hard to reach spaces on model cars, model airplanes, model ships and model railroads.

Machinery and Engines

Removing oil and lint from interiors of sewing machines without leaving lint behind as a cotton or foam tipped swabs do.

mineral build up on interiors of sprinklers for lawns, fire extinguishing equipment or grocery produce displays.

I claim:

1. An abrasive swab comprising:

(a) an elongated shaft having opposite first and second ends, said shaft adapted for manual manipulation by the user; and (b) a quantity of spun metal extending around and covering one of the ends of the shaft, said spun metal being adhesively secured to the shaft.

2. The abrasive swab of claim 1, wherein the shaft is wood.

3. The abrasive swab of claim 1, wherein the shaft is plastic.

4. The abrasive swab of claim 1, wherein the shaft is metal.

5. The abrasive swab of claim 1, wherein a quantity of spun metal also extends around and covers the other end of the shaft and is adhesively secured thereto.

* * * * *